US005252933A

United States Patent [19]

Kamino et al.

[11] Patent Number: 5,252,933

[45] Date of Patent: Oct. 12, 1993

[54] CIRCUIT BREAKER INCLUDING FORCED CONTACT PARTING MECHANISM CAPABLE OF SELF-RETAINING UNDER SHORT CIRCUIT CONDITION

[75] Inventors: Toshihide Kamino, Kishiwada; Takeshi Yura, Habikino, all of Japan

[73] Assignee: Terasaki Denki Sangyo Kabushiki Kaisha, Osaka, Japan

[21] Appl. No.: 728,416

[22] Filed: Jul. 11, 1991

[30] Foreign Application Priority Data

Jul. 16, 1990 [JP] Japan ..... 2-188497
Nov. 30, 1990 [JP] Japan ..... 2-338541

[51] Int. Cl.[5] ..... H01H 9/00
[52] U.S. Cl. ..... 335/172; 335/21
[58] Field of Search ..... 335/172-175, 335/14, 20, 159-162, 21-23

[56] References Cited

U.S. PATENT DOCUMENTS 4,631,507 12/1986 Guery et al. .
4,947,145 8/1990 Ohishi et al. ..... 335/14

FOREIGN PATENT DOCUMENTS

0079819B1 5/1983 European Pat. Off. .
0179677 4/1986 European Pat. Off. .
0237607A1 9/1987 European Pat. Off. .
0287752 10/1988 European Pat. Off. .
0315093A2 5/1989 European Pat. Off. .
0362871 4/1990 European Pat. Off. .
2719053A1 11/1977 Fed. Rep. of Germany .
2400761 3/1979 France .
14-5573 4/1939 Japan .
39-5573 12/1961 Japan .
52-132382 4/1977 Japan .
63-36097 11/1982 Japan .
1210102 10/1970 United Kingdom .
1393799 5/1975 United Kingdom .
1550573 8/1979 United Kingdom .
2166906A 5/1986 United Kingdom .
2178597A 2/1987 United Kingdom .
2178597 2/1987 United Kingdom .

*Primary Examiner*—Lincoln Donovan
*Attorney, Agent, or Firm*—Lowe, Price, LeBlanc & Becker

[57] ABSTRACT

Disclosed is a circuit breaker including a first linking member for switching fixed contacts provided in a main current path. The first linking member is operated by a circuit switching mechanism using a voltage-operated electromagnet, a forced contact parting mechanism upon short circuit condition using a current-operated electromagnet connected in series to the main path, and a spring releasing mechanism responsive to flow of overcurrent for operating. The forced contact parting mechanism upon short circuit condition includes a link mechanism including self-retaining/self-resetting function between the first linking member and the current-operated electromagnet.

10 Claims, 16 Drawing Sheets

CIRCUIT BREAKER INCLUDING FORCED CONTACT PARTING MECHANISM CAPABLE OF SELF-RETAINING UNDER SHORT CIRCUIT CONDITION

BACKGROUND OF THE INVENTION

1. Field of the Invention

The present invention relates generally to a circuit breaker, and more particularly, to a circuit breaker which functions both as a circuit breaker and an electromagnetic switch.

2. Description of the Background Art

A circuit breaker is generally for protecting a current path and associated equipment against overload current or short-circuit current. If a load is switched frequently, an electromagnetic switch connected in series with a circuit breaker is provided, and the load is switched by the electromagnetic switch having a long useful life as a switch.

Three types have been conventionally known in the prior art of an apparatus formed by uniting the functions of the circuit breaker and the electromagnetic switch.

The first type is for example the one disclosed in Japanese Patent Laying-Open No. 52-132382. In the apparatus of this type, the function of the circuit breaker and the function of the electromagnetic switch are integrally combined, and contacts are separately provided each for short circuit breaking and for switching a load. Although superior in performance, the apparatus of this type is usually oversized and therefore is not economical.

The apparatus of the second type is, for example, disclosed in Japanese Patent Publication No. 39-5573. The apparatus of this type switches a load by mechanically linking an electromagnet for operation and a contact, and disconnects the linking of the mechanism when an overcurrent is generated. In other words, the linking mechanism is of trip-free system and the linking is disconnected when an overcurrent tripping device operates to cause the electromagnet for operation to part contacts. Therefore, high speed breaking is possible. However, the mechanism of this trip-free system is complicated, and a long useful life as a switch is not expected because the trip-free mechanism is operated simultaneously with the switching operation.

An apparatus of the third type is, for example, disclosed in Japanese Patent Publication No. 63-36097. The apparatus of this type has an electromagnet for operation and an electromagnet for short circuit protection, and an overcurrent tripping device. The electromagnet for operation and the electromagnet for short circuit protection both directly act upon the linking means of a contact device. The apparatus of this type is superior in switching endurance strength. Against a large current, the electromagnet for short circuit protection directly opens contacts and at the same time the overcurrent tripping device operates to cut off the excitation current from the electromagnet for operation, thereby de-energizing the electromagnet.

In the circuit breaker of the third type, however, when breaking a large current, the contacts are opened by the operation of the electromagnet for short circuit protection and the current is once broken. As the electromagnet for short circuit protection being de-energized when the current is cut off, a large current is liable to conduct once again. However, the circuit breaker is provided with a latch mechanism for preventing re-conduction of the circuit. The latch mechanism of this type does not include an automatic resetting mechanism, and, therefore, it is necessary to manually reset the latch circuit to turn on the circuit again.

SUMMARY OF THE INVENTION

It is an object of the present invention to provide a circuit breaker having a re-conduction prevention mechanism capable of opening a circuit instantly upon an excessive flow of current, and after the completion of the opening, automatically resetting the circuit to a state in which the circuit can be turned on once again.

A circuit breaker in accordance with the present invention includes fixed contacts provided in a main current path, a moving contact member including moving contacts for performing switching operation between fixed contacts, a first linking member engaged to the moving contact for permitting contact switching operation of the moving contact member, a second linking member for operating a plurality of the first linking members simultaneously, an overcurrent responsive device provided in the main current path and responsive to detection of an overcurrent for operating, a forced contact parting device upon short circuit condition, and at least one of a spring releasing mechanism for opening the fixed contacts of the main current path and a circuit switching mechanism.

The spring releasing mechanism includes a toggle link mechanism having a spring, a lever disposed at one end of the link of the toggle link mechanism for operating the second linking member, and a latch mechanism for transmitting a responsive operation signal from the overcurrent responsive device to the toggle link mechanism and for discharging the spring. When the spring is in a fully charged state, the lever maintains the second linking member at a position where the moving contacts can be contacted, and when the latch mechanism operates in response to the responsive operation signal from the overcurrent responsive device, the spring is discharged, whereby the lever moves the second linking member to a position where the moving contacts are parted.

The circuit switching mechanism includes a voltage-operated electromagnet having a moving portion moved in response to a switching instruction for the main current path, a fixed portion and a spring for releasing. The moving portion is moved by the spring for releasing in a non-excitation state to move the second linking member to a position where the moving contacts are parted.

The forced contact parting device upon short circuit condition includes a current-operated electromagnet provided in the main current path and responsive to an excessive flow of current beyond a prescribed value for operating, and a link mechanism linked between the current-operated electromagnet and the first linking member. The linking mechanism moves the first linking member in response to operation of the current-operated electromagnet to part the moving contacts and to keep the engagement state to the first linking member. After the current-operated electromagnet returns to a non-operative state, the link mechanism still keeps the engagement to the first link member. Furthermore, when either the spring releasing mechanism or the voltage-operated electromagnet operates to further move the first linking member through the second linking member, so that the open state of the moving contacts is maintained, the link mechanism is released from the engagement to the first linking member, spontaneously returning to a waiting state.

Upon an excessive flow of electric current such as short circuit current, a forced contact parting electromagnet upon short circuit condition operates to cause the first linking member through the link mechanism to move the moving contacts to a parted position, thereby opening the fixed contacts and breaking the current. The forced contact parting electromagnet for short circuit protection then returns to a non-operative state, but the link mechanism has its position held in the state while opening the fixed contacts. At the same time, the spring releasing mechanism is operated by the overcurrent responsive device, upon detection of the short circuit current, or the voltage-operated electromagnet is brought into a non-excited state, so that the first linking member is restrained through the second linking member, to keep the open state between the fixed contacts. The first linking member moves further toward a parting direction from a self-retaining state, and the link mechanism held in place spontaneously returns to the original state, in other words returning to a state in which the circuit breaker can be turned on in response to an instruction.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
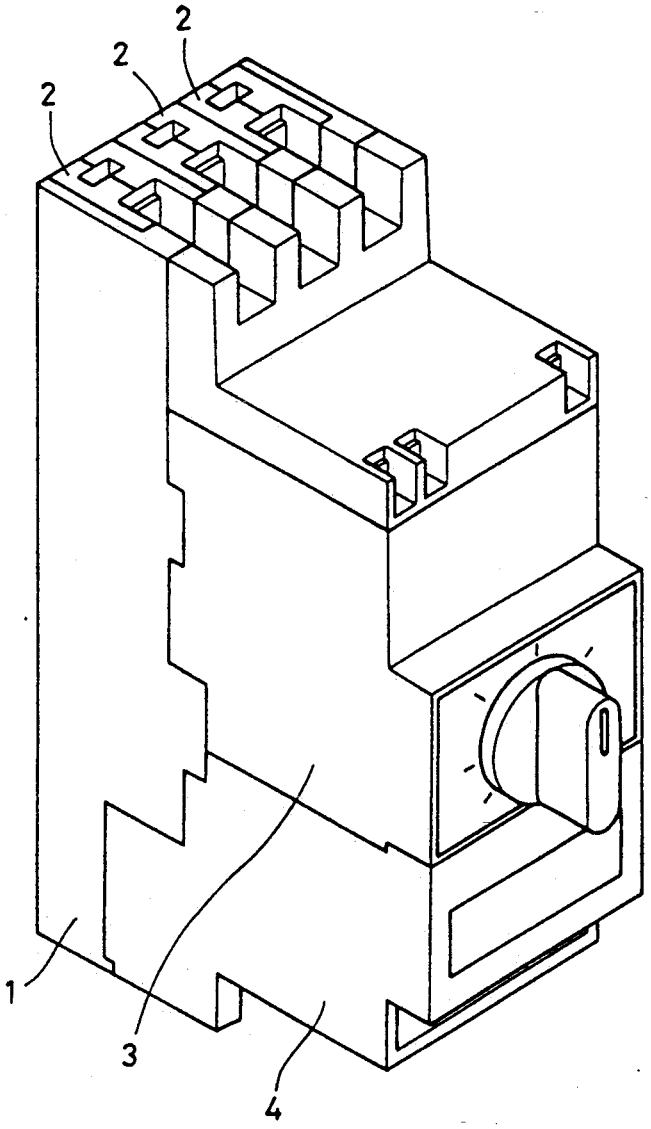
FIG. 1 is an overview illustration schematically showing a circuit breaker in accordance with one embodiment of the present invention.
Figure 15:
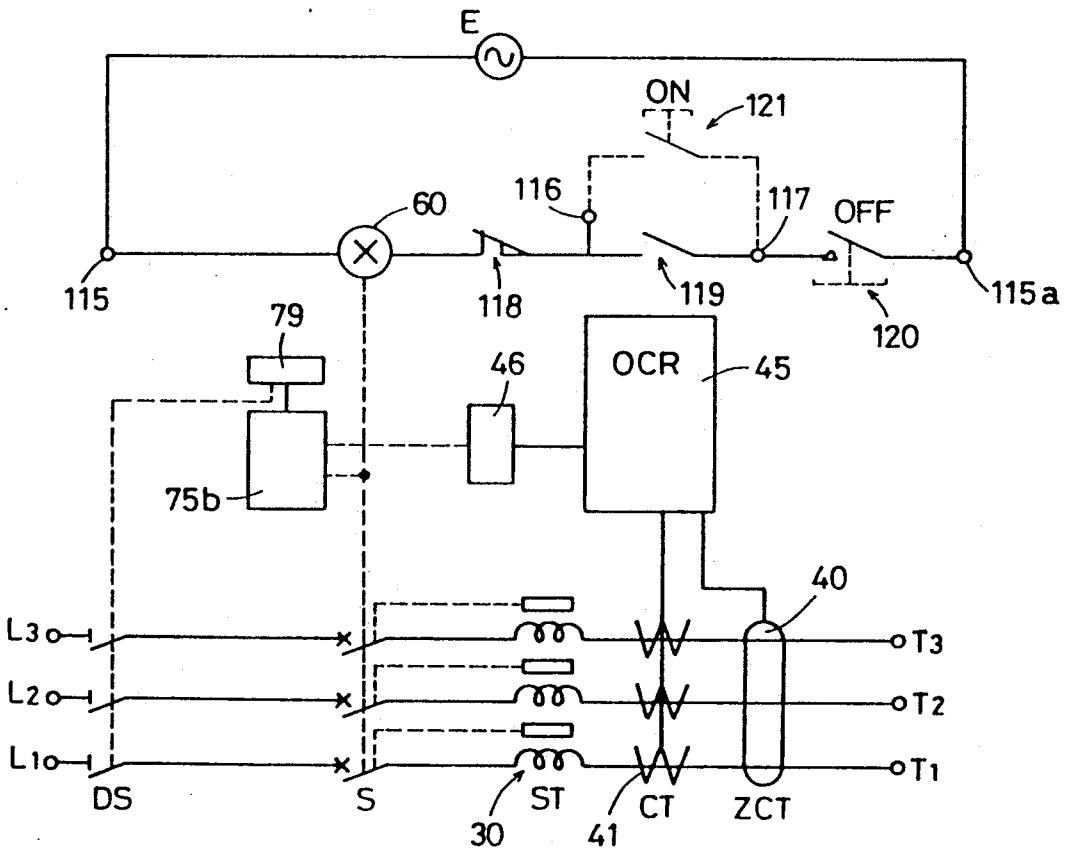
FIG. 15 is a circuit block diagram showing a circuit breaker.

Referring to FIG. 1, the housing of a circuit breaker is formed of six parts, i.e. a base 1, an operational mechanism unit housing 3, a tripping unit housing 4 and three independent switching breaking unit housings 2. Referring to FIG. 15, the circuit breaker has three independent main current paths. Disconnecting contacts DS, main contacts S, a forced contact parting electromagnet upon short circuit condition ST, a current transformer for current detection CT and a zero phase current transformer ZCT are provided in each of the paths. Three contact parting devices are provided as contact switching means for switching the main contacts. The first contact parting device switches the main contacts S using an electromagnet 60 for switching operation. The second contact parting means breaks the main contacts S by a spring releasing mechanism **75*b*** which operates in response to a detection signal from the current transformer for current detection CT provided in the main current path or the zero phase current transformer ZCT. The third contact parting device breaks the main contacts S by operation of the contact parting electromagnet upon short circuit condition ST provided in the main current path. Now, description will be given on the structure of the circuit breaker having such circuit configuration and mechanism.

Figure 2:
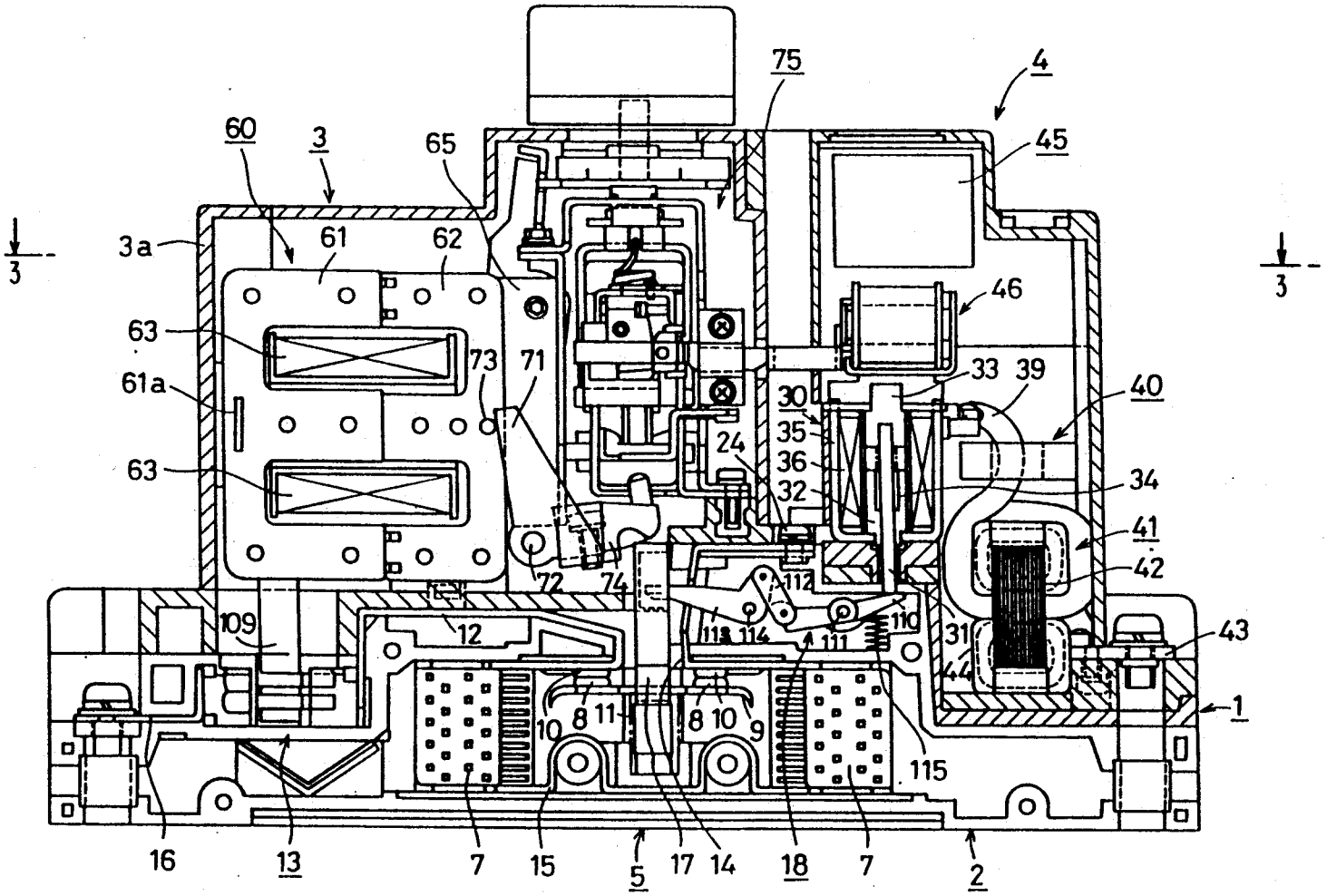
FIG. 2 is a sectional view showing a structure of a circuit breaker.
Figure 3:
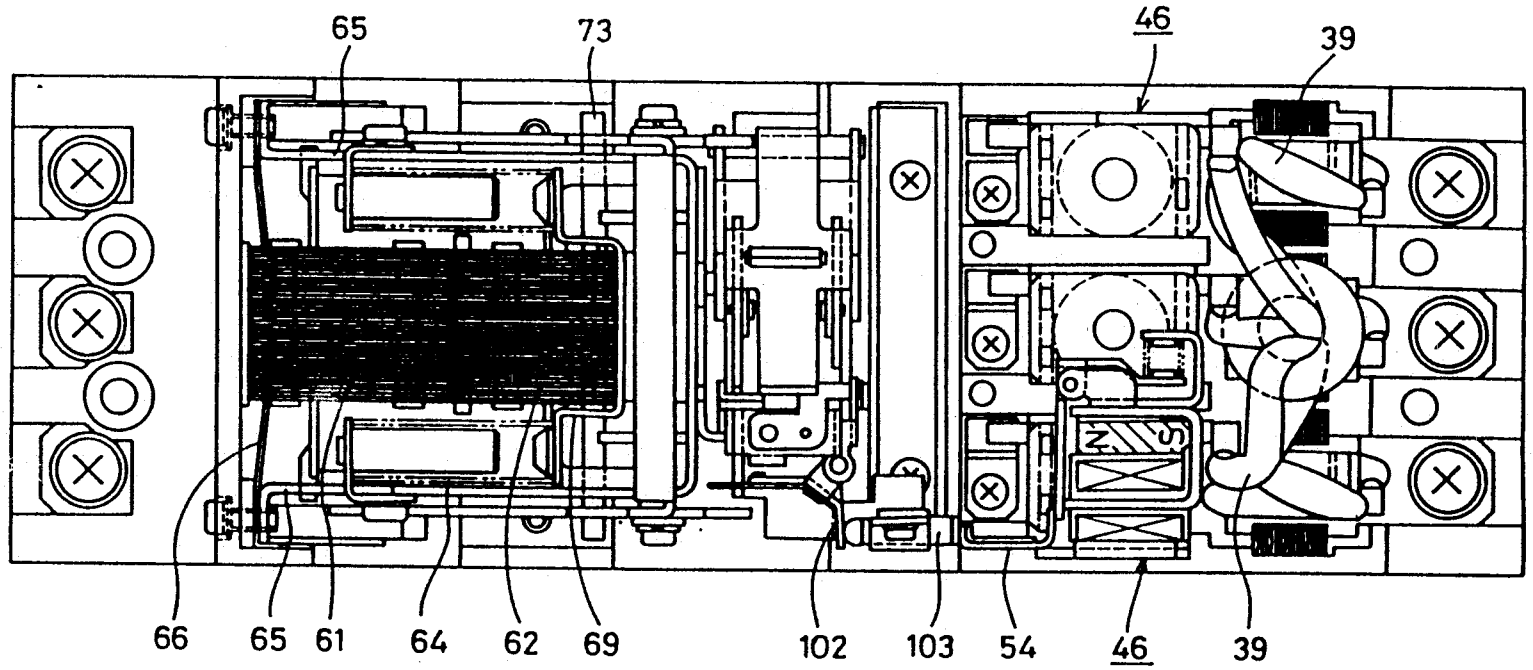
FIG. 3 is a top view showing the structure of the circuit breaker in FIG. 2 taken along line 3—3.

Referring to FIGS. 2 and 3, provided to the circuit breaker are: a hollow base 1 formed of molded insulator; switching breaking unit housings each independently provided for each of the paths and formed of molded insulator insert-mounted from the bottom of the base 1; an operational mechanism unit housing 3 of insulator formed on one side on the top of the base 1; and a tripping unit housing 4 of molded insulator formed on the other side on the top of the base 1.

The switching breaking unit housing 2 is of a long and narrow shape, and a current path is constituted, which leads from a power supply side terminal conductor 16 disposed at one end of the housing 2 via a disconnecting portion 13 to a first fixed conductor 12, main contacts 5 and a second fixed conductor 14. Arc-extinguishing devices 7, 7 are disposed on both sides of the main contacts 5. The main contacts 5 include: a pair of fixed contacts 10, 10 provided to the first and second fixed conductors 12 and 14; a moving contact member 9 of bridging type having moving contacts 8, 8 each in a position in contact with each of the fixed contacts 10, 10; a contact spring 11 supporting the moving contact member 9 from the bottom and constantly pressure-contacting the moving contact 8 to the fixed contacts; and a switching operation lever 17 connected to the moving contact member 9 and extending in the vertical direction thereto. In the switching operation of the main contacts 5, the fixed contacts 10, 10 and the moving contacts 8, 8 are parted by lowering the switching operation lever 17, and as for the drawback movement, the retaining strength of the contact spring 11 permits the fixed contacts 10, 10 and the moving contact 8, 8 to come into contact.

The first fixed conductor 12 having one of the fixed contacts 10, 10 have one end extended to the top of the arc-extinguishing device 7 to form an arcing horn, and the other end extending to the disconnecting portion 13. The second fixed conductor 14 having the other fixed contact 10 has one end extended to the top of the arc-extinguishing device 7 to form an arcing horn, and the other end bent back and extended along the top of the housing 2, so as to be exposed in the trenched portion of the tripping unit housing 4 through the through-holes of the base 1.

Provided in the vicinity of the top of the main contacts 5 within this switching breaking unit housing 2 is a forced contact parting link mechanism upon short circuit condition 18. Further description will be given on the mechanism later.

Further, an arc runner 15 provided along the bottom wall of the switching breaking unit housing 2 is provided on the bottom of the arc-extinguishing devices 7, 7 in correspondence to an arc runner portion formed extended to the side of the fixed contacts 10, 10 of the first fixed conductor 12 and the second fixed conductor 14.

A forced contact parting electromagnet upon short circuit condition 30, a zero phase current transformer 40; a current transformer for current detection 41, and a load side terminal conductor 43 are included inside the tripping unit housing 4 and connected in series, to constitute the main current path.

The forced contact parting electromagnet upon short circuit condition 30 is a plunger type electromagnet formed of a fixed core 32, a moving core 33, a drawback spring 34, a magnetic yoke 35, and an excitation coil 36. A protruding rod 31 is integrally mounted on the moving core 33. The tip of the protruding rod 31 abuts the first lever 110 of the forced contact parting link mechanism upon short circuit condition 18 through through holes provided to the tripping unit housing 4, the base 1 and the switching breaking unit housing 2. The input end of the excitation coil 36 is connected by a screw 24 to the second fixed conductor 14 exposed on the top of the switching breaking unit housing 2, and an output conductor 39 is wound as a primary coil around one part of the core 42 of the current transformer for current detection 41 through the through holes of a single zero phase current transformer 40 provided according to demand and used in common by the three paths.

The primary coil of the current transformer for current detection 41 has its conducting end connected to one end of the load side terminal conductor 43. A secondary coil 44 is wound around the other part of the core 42 of the current transformer for current detection 41, and the conducting line of the secondary coil is connected as an input of an electronic overcurrent relay 45 disposed on the top thereof.

The main current path leading from the power supply side terminal conductor 16 to the load side terminal conductor 43 is thus structured.

Now, description will be given on the structure of three contact parting means of the main contact 5.

Figure 4:
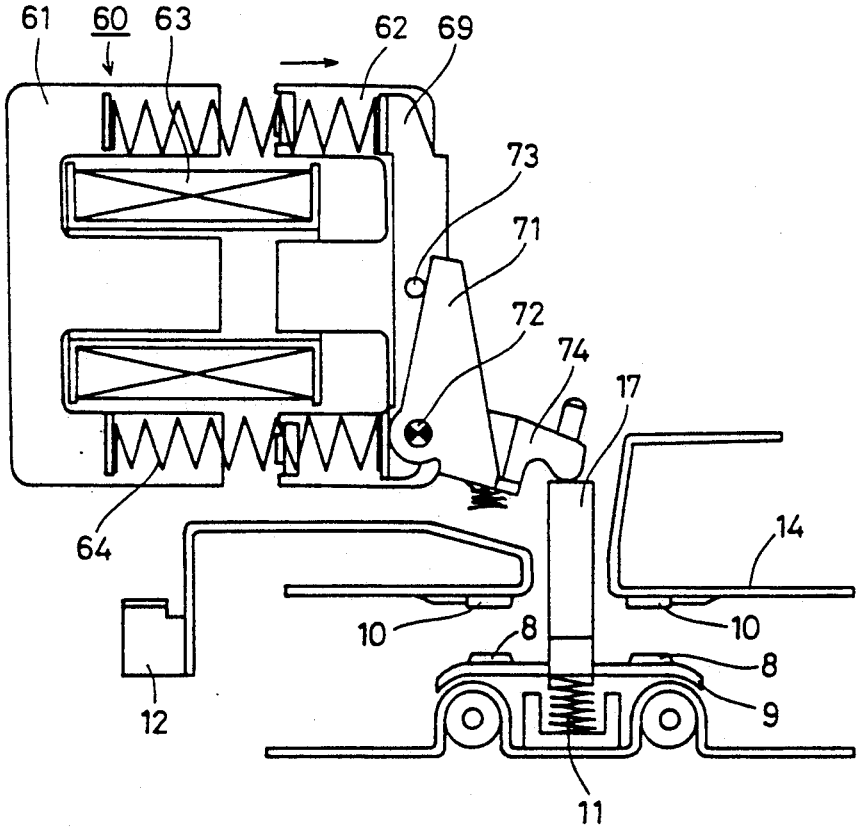
FIG. 4 is a view partially showing the structure of the forced contact parting device of the circuit breaker.

First, description will be provided on a structure using an electromagnet for switching operation 60 as the first contact parting means. Referring to FIGS. 2 to 4, the electromagnet for switching operation 60 and an operation control mechanism 75 are disposed in an operation mechanism unit housing 3. The electromagnet for switching operation 60 is formed of an E-shaped fixed core 61, a corresponding E-shaped moving core 62, an excitation coil 63 wound around the central leg of each of the cores, and a spring for releasing attraction 64. The fixed core 61 of the electromagnet for switching operation 60 together with a fixed frame 65 is fixed to the end cover 3*a* of the operation mechanism unit housing and supported by a plate spring 66 inserted through a small through hole 61*a* provided to the fixed core 61. The moving core 62 is attached movably to the fixed frame 65 through the spring for releasing attraction 64 fitted between the fixed frame 65 and a spring disposition plate 69 mounted integrally with the moving core 62. The spring for releasing attraction 64 always energizes the moving core 62 in a direction away from the fixed core 61. Formed on the moring core 62 is a moving core movement pin 73 which provided through the moving core 62 and moves together with the moving core 62. Further, an electromagnet movement lever 71 engaged to the moving core movement pin 73 is pivotably attached centered on an axis 72 at one end of the fixed frame 65. A cross bar 74 is attached at one end of the electromagnet movement lever 71. The cross bar 74 is formed of an integral form which simultaneously abuts the heads of the switching operation levers 17, 17, 17 protruding from the three switching breaking unit housings 2, 2, 2 arranged in parallel inside the base 1.

Now, description will be given on the second contact parting means in conjunction with FIGS. 2, 3, 5 and 6.

Figure 5:
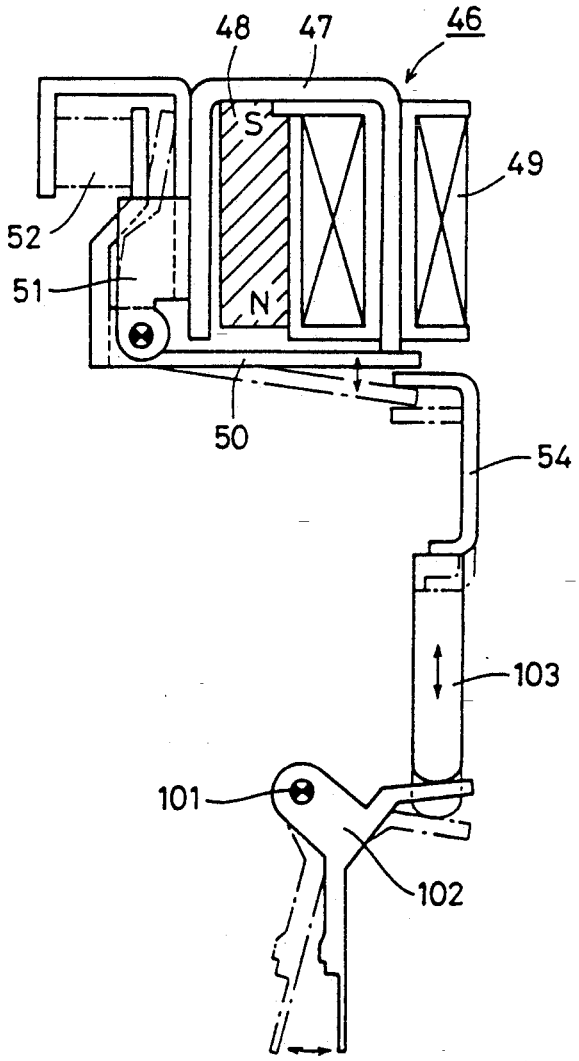
FIG. 5 is a top view for illustrating the structure of a release type electromagnet 46 and the transmission mechanism linked thereto.

The second contact parting means is formed of devices disposed along a path from one end of the secondary coil 44 of the current transformer for current detection 41 via the electronic overcurrent relay 45, a releasing type electromagnet 46, and further through an operation control mechanism 75 to the cross bar 74 used in common for operating the three paths. Referring to FIG. 5, the releasing type electromagnet 46 includes a U-shaped frame 47 formed of a magnetic material, a permanent magnet 48 disposed inside the U shaped frame, a tripping coil 49 wounded around one end of the U-shaped frame 47, an armature 50, a supporting member 51 pivotably supporting the armature 50, and a tripping spring 52. In the releasing type electromagnet 46, the armature 50 is kept attracted to the leg of the U-shaped frame 47 against the effect of the tripping spring 52 by a flux always supplied by the permanent magnet 48. If an output signal is input to the tripping coil 49 from the electronic overcurrent relay 45 in this state, a flux is generated in the direction of canceling the flux of permanent magnet 48, thereby parting the armature 50 from the leg of the U shaped frame 47. One end of the armature 50 abuts a tripping transmission plate 54 for transmitting the parting movement of the armature 50, and the other end of the tripping transmission plate 54 abuts one end of a movement responsive transmission plate 103. The other end of the movement responsive transmission plate 103 abuts one end of an overload responsive tripping movement plate 102. The overload responsive tripping movement plate 102 rotates centered on an axis 101. The other end of the overload responsive tripping movement plate 102 faces to the second hook 99 of the operation control mechanism 75 shown in FIG. 6. The transmission mechanism shown in FIG. 5 permits a detection signal indicating detection of an excessive flow of current in the main current path to be transformed into a mechanical signal.

Figure 6:
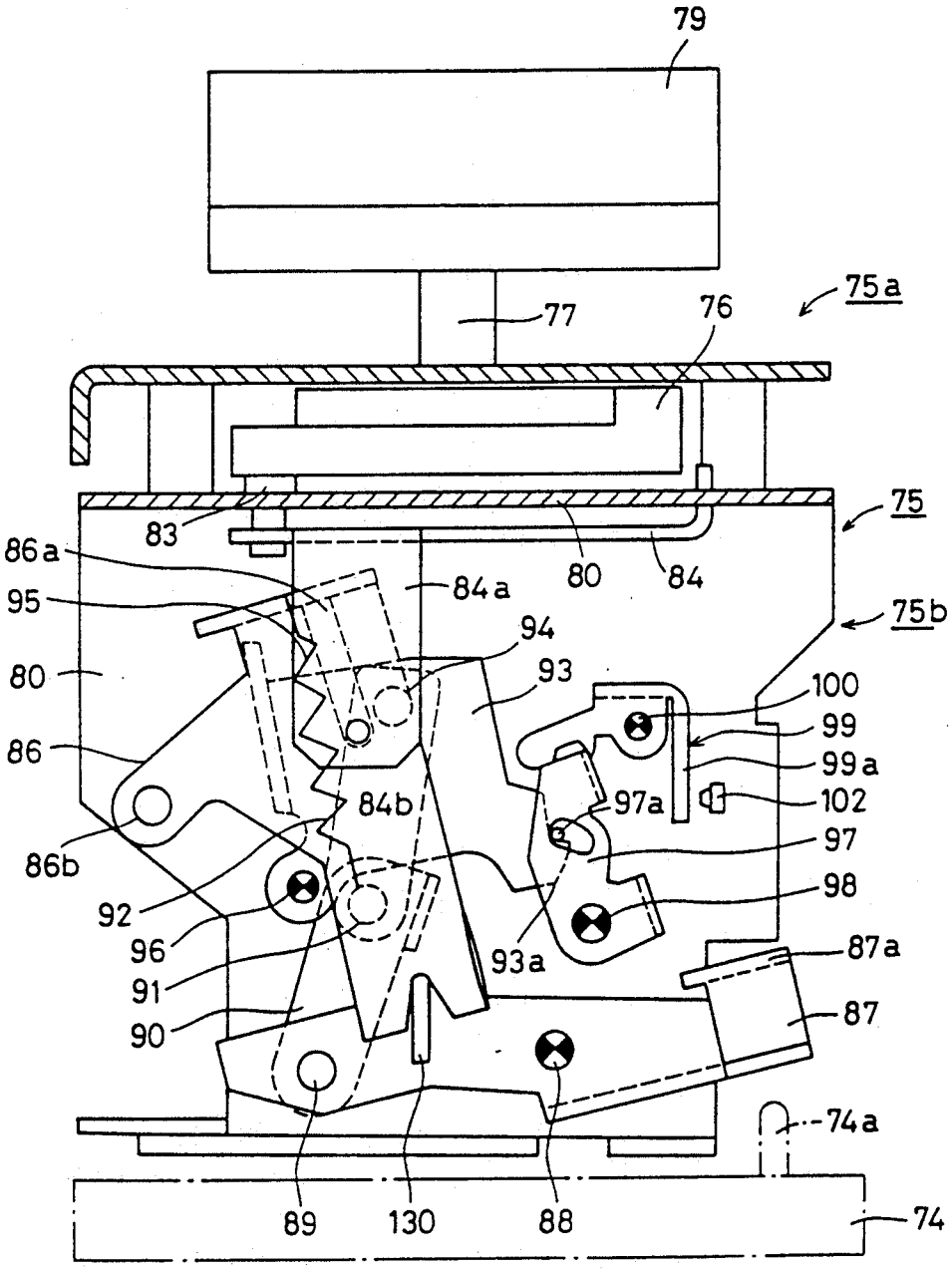
FIG. 6 is a sectional view showing a structure of an operational control mechanism.
Figure 7A:
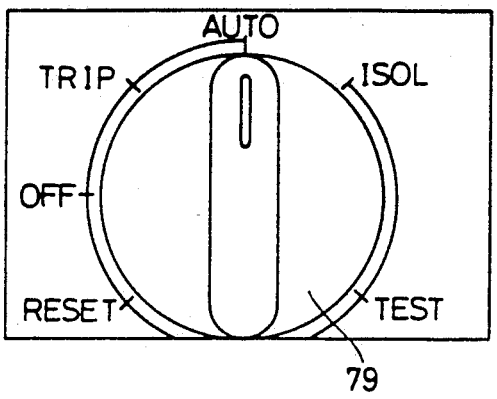
FIGS. 7A, 9A and 11A are sectional views each showing a control handle 79 in each switching position.
Figure 7B:
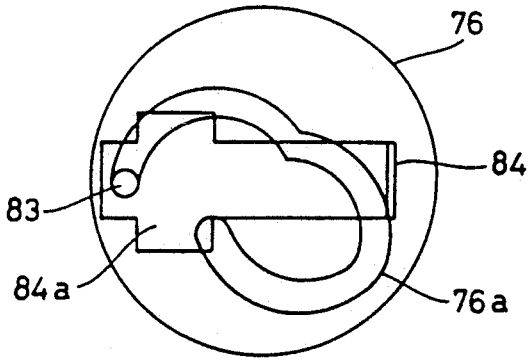
FIGS. 7B, 9B and 11B are top views each showing a structure of an eccentric cam 76 and a slide plate 84 corresponding to FIGS. 7A to 11A, respectively.
Figure 8A:
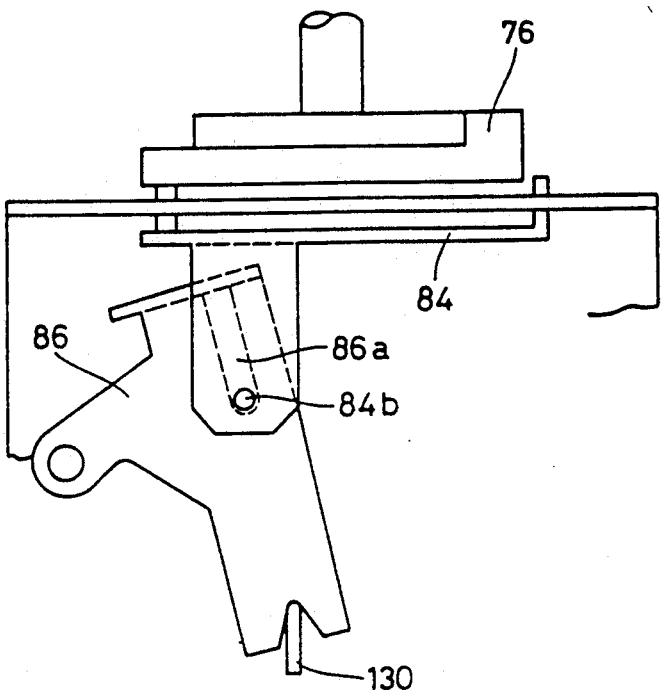
FIGS. 8A, 10A and 12A are sectional views each showing a structure of a handle control mechanism corresponding to FIGS. 7A to 11A, respectively.
Figure 8B:
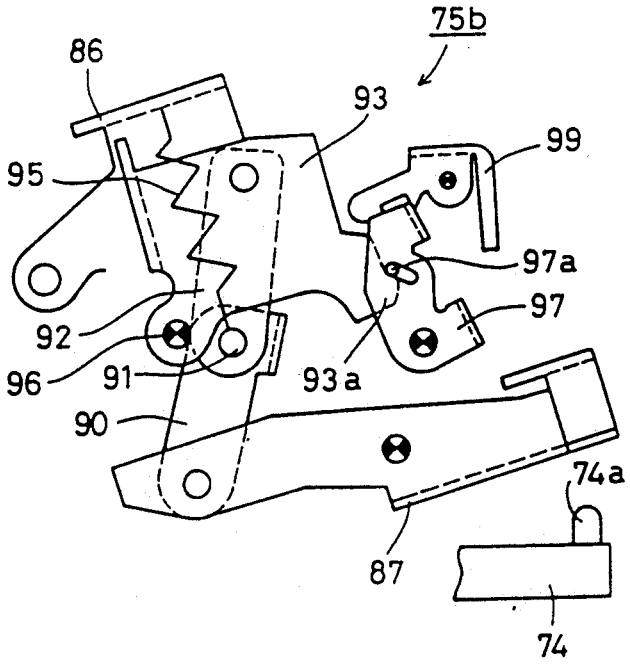
FIGS. 8B, 10B and 12B are sectional views each showing a structure of a spring releasing mechanism corresponding to FIGS. 8A to 12A, respectively.
Figure 9A:
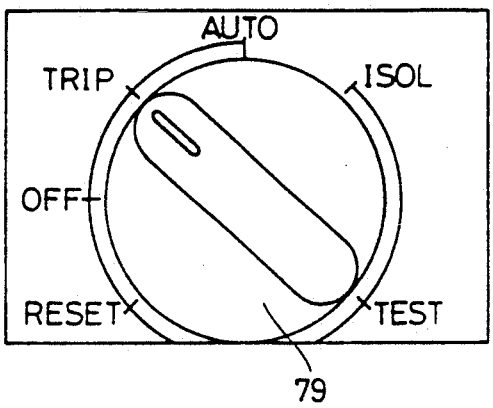
Figure 9B:
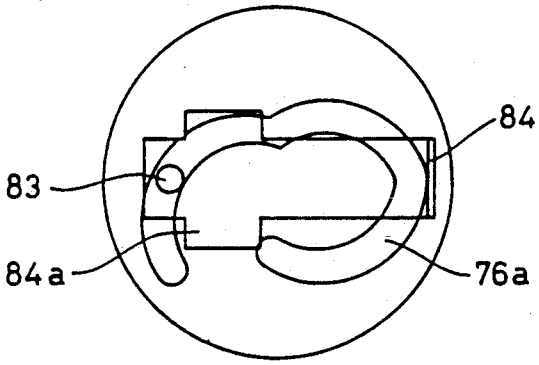
Figure 11A:
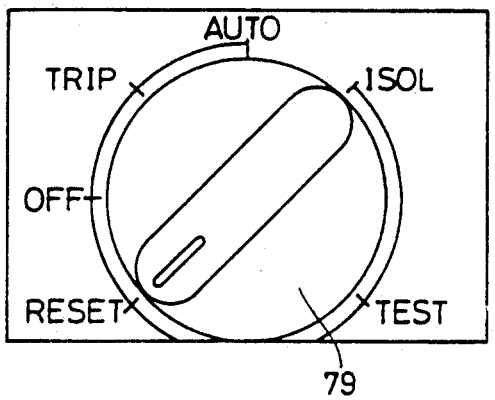
Figure 11B:
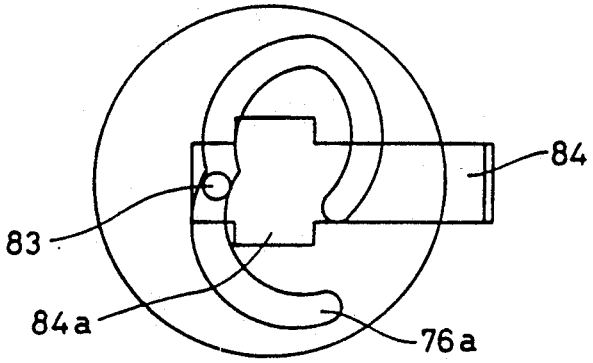
Figure 12A:
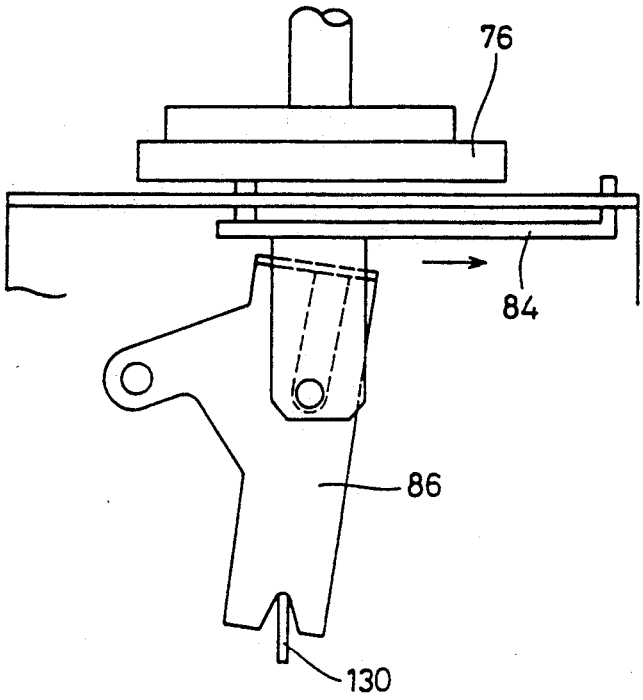
Figure 12B:
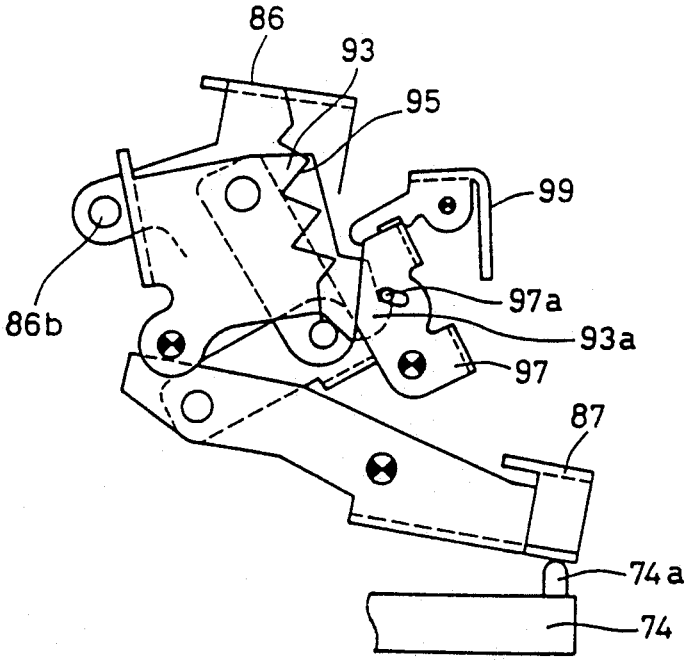

Now, referring to FIG. 6, description will be given on the structure of the operation control mechanism 75. The operation control mechanism 75 can be roughly divided into a handle mechanism portion 75*a* operated by a control handle 79, and a spring releasing mechanism portion 75*b* for mechanically switching the main contact. The handle mechanism portion 75*a* includes the control handle 79, a cam shaft 77 attached to the control handle 79, an eccentric cam 76 linked to the cam shaft 77, and a slide plate 84 linked to the eccentric cam 76 for sliding movement. The control handle 79 is supported pivotably, and has six switching positions, "AUTO", "TRIP", "OFF", "RESET", "TEST", and "ISOL". A cam trench 76a shown in FIGS. 7B, 9B and 11B is formed on the bottom of the eccentric cam 76, and a tip of the slide plate sliding pin 83 is inserted in the cam trench. The slide plate sliding pin 83 is calked to one end of the slide plate 84 through a linear guide hole provided on a fixed frame 80. A part of the slide plate 84 has an ear 84a bent in an inverted U shape. In the above-described structure, when the control handle 79 is pivoted, the pivotal movement is transformed into linear movement of the slide plate 84 by the function of the eccentric core cam 76.

The spring releasing mechanism 75b includes in the engaging order, a second hook 99, a first hook 97, a releasable lever 93, a link 92, a link 90 and a cross bar control lever 87. A bent part 99a of the second hook 99 is provided in a position facing to one end of the overload responsive tripping movement plate 102, and receives the pivotal movement of the overload responsive tripping movement plate 102. The tip of the cross bar control lever 87 abuts the head 74a of the cross bar 74 for operating three systems at the time.

The second hook 99 is pivotably supported on an axis 100, and has one end releasably butt-engaged to the upper end of the first hook 97, the bent part 99a being provided at the other end. The first hook 97 is pivotably supported on an axis 98, and is supplied with clockwise rotating strength by the spring. A movable hooking pin 97a is attached along an elongate hole in the center of the first hook 97. The releasable lever 93 is pivotably supported on an axis 96 with one end fixed to the fixed frame 80, and the nail 93a of the other end is releasably engaged to the hooking pin 97a of the first hook 97. Linked to the top of the releasable lever 93 is a link 92 having one end pivotably connected thereto by an axis 94. The other end of the link 92 is connected to a link 90 through a toggle axis 91, and one end of the link 90 is connected to one end of the cross bar control lever 87 pivotably supported on an axis 88 through an axis 89. These two links 90, 92, the toggle axis 91 therebetween, and an extension spring 95 connected between the toggle axis 91 and the peak of the switching control lever 86 constitute a toggle link mechanism. The switching control lever 86 has its lower end engaged to a fixed bar 130 fixed to the fixed frame 80, and pivotably provided centered on the fixed bar 130.

A pin 84b provided at the tip of the ear 84a of the slide plate 84 is inserted slidably in the trenches 86a provided on the top of both sides of the switching control lever 86. The spring releasing mechanism 75b and the handle operating mechanism 75a are thus linked. The operation control mechanism 75 is a mechanism for switching the main contact of the main current path by operating the cross bar 74 by moving up and down the cross bar control lever 87, and there are two instruction input systems as the operation instruction system thereof. In one system, the spring releasing mechanism 75b is operated through the handle control mechanism 75a by the operation of the handle 79. In the other system, an abnormal signal detected by the current transformer for current detection 41 is transformed into a mechanical signal by the releasing type electromagnet 46, and then the second hook 99 is operated through the overload responsive tripping movement plate 102.

Now, description will be provided on the third contact parting means in conjunction with FIG. 2. The protruding rod 31 of the forced contact parting electromagnet upon short circuit condition 30 arranged in series in the main current path abuts the first lever 110 of the forced contract parting link mechanism upon short circuit condition provided inside the switching breaking unit housing 2. The first lever 110 has its central portion pivotably supported by a pivot axis 111. The other end of the first lever 110 is linked to a link member 112, the other end of the link member 112 is linked to a second lever 113. The second lever 113 is approximately of an N shape, and has the central portion supported pivotably by an axis 114. The first lever 110, the link member 112 and the second lever 113 constitute a so-called dead center link mechanism. A drawback spring 115 which always energizes the protruding rod 31 of the forced contact parting electromagnet upon short circuit condition 30 toward the drawing back side is provided at one end of the first lever 110. The tip end of the second lever 113 is inserted inside a hollow formed on the top of the switching operation lever 17 of the main contact. The operation of the forced contact parting electromagnet upon short circuit condition 30 causes the protruding rod 31 to operate, thereby moving the switching operation lever 17 through the forced contact parting link mechanism upon short circuit condition 18, parting between the fixed contacts 10, 10 and the moving contacts 8, 8 and opening the main current path as a result.

Now, description will be provided on the contact switching operation of the circuit breaker in accordance with the present invention.

Contact switching operation using the first parting means, i.e. the electromagnet for switching operation 60 will be described in conjunction with FIG. 4. The electromagnet for switching operation 60 operates in response to a switching instruction from an ON/OFF switch, etc. provided externally to the circuit breaker. Upon cutting off the excitation of the excitation coil 63 of the electromagnet for switching operation 60 in response to an externally applied signal, the moving core 62 moves parted from the fixed core 61 due to the retaining strength of the spring for releasing attraction 64. In response to the above-described movement, the moving core movement pin 73 provided at the moving core 62 causes the electromagnet movement lever 71 to rotate clockwise centered on the axis 72. The cross bar 74 lowers the switching operation lever 17, and the moving contacts 8 and 10 of the moving contact 9 and the fixed contacts 10, 10 are parted accordingly. The circuit is thus disconnected.

In drawback movement, upon reconduction of the excitation coil 63, the moving core 62 is attracted to the fixed core 61, and the electromagnet movement lever 71, the cross bar 74 and the switching operation lever 17 return to their original positions accordingly.

Now, description will be given on breaking operation of the main contact by the second parting means, i.e. the spring releasing mechanism in conjunction with FIGS. 2, 5, 7A, 7B, 8A, 8B, 9A, 9B, 10A, 10B, 11A, 11B, 12A and 12B.

Referring to FIGS. 7A through 8B, if the main current path of the circuit breaker is closed, the control handle 79 is in a position of "AUTO" or "TEST", the nail 93a of the releasable lever 93 is engaged to the hooking pin 97a of the first hook 97 in the spring releasing mechanism 75b, and the upper end of the first hook 97 is engaged to one end of the second hook 99. The toggle axis 91 for linking the two toggle links 90, 92 is under tension through the upper end of the switching control lever 86 and the extension spring 95, and the top of the link 90 is stopped by the axis 96. The toggle links 90 and 92 are therefore extended approximately in a straight line, the cross bar control lever 87 having one end lowered, the side abutting the cross bar 74 being raised and parted from the pin 74*a* of the cross bar 74.

Assuming that the control handle 79 is in a position of "AUTO" and the main contacts 8, 10 are in positions of "ON", an overload current flows through the main current path and the releasing type electromagnet 46 operates in response to an output signal from the electronic overcurrent relay 45, the armature 50 is caused to open, and the tripping transmission plate 54 and the overload responsive transmission plate 103 are pressed to slide, thereby causing the overload responsive tripping movement plate 102 to pivot and pressure-moving the bent part 99*a* formed at the end of the second hook 99 to move as a result.

Figure 10A:
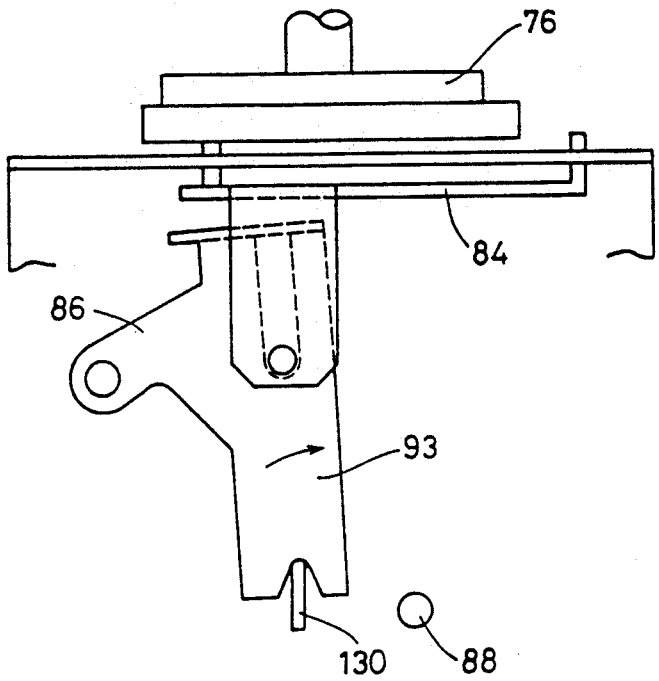
Figure 10B:
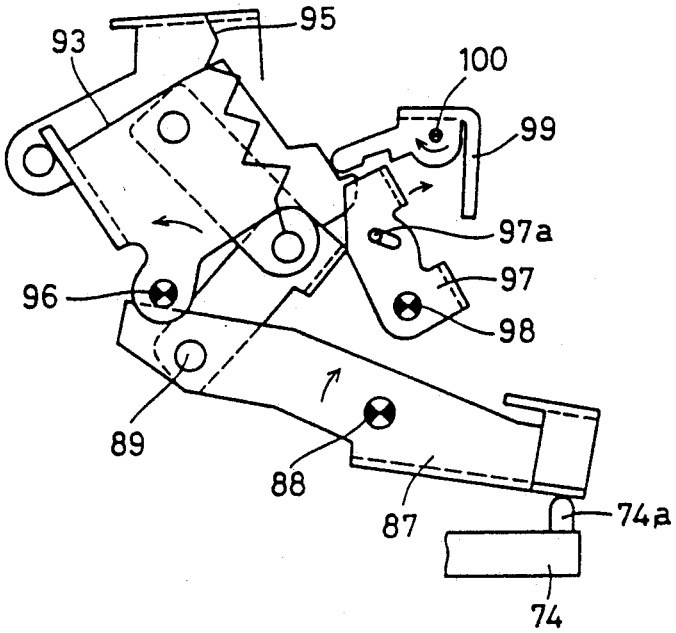

Referring to FIG. 10B, upon clockwise pivotal movement of the second hook 99 centered on the axis 100 as a supporting point, the first hook 97 de-engaged from the second hook 99 is pivoted clockwise centered on the axis 98 as a supporting point, thereby releasing the engagement between the hooking pin 97*a* and the releasable lever 93. The releasable lever 93 raises one end of the cross bar control lever 87 by pivoting anticlockwise on the axis 96 as a supporting point, and by bending the toggle links 90 and 92. The cross bar control lever 87 therefore pivots clockwise on the axis 88 as a supporting point to lower the pin 74*a* of the cross bar 74. When the cross bar 74 is lowered, the operation levers 17, 17, and 17 of the three paths in abutment against the cross lever 74 are lowered, thereby releasing the main contact to attain an "OFF" state. At this time, the slide plate 84 in engagement to the switching control lever 86 the ear 84*a* is slided by the pivotal movement of the switching control lever 86 to cause pivotal movement of the eccentric cam 76 and the control handle 79, and the control handle 79 is pivoted to a position instructing "TRIP" (see FIGS. 9A, 9B and 10A).

Referring to FIGS. 11A to 12B, for returning the "TRIP" state to a switchable state, the control handle 79 is forced to pivot to a position of "RESET" to cause the switching control lever 86 to pivot clockwise, the releasable lever 93 is pivoted clockwise by the pin 86*b* mounted at one end of the switching control lever 86, the nail 93*a* of the releasable lever 93 is engaged to the hooking pin 97*a* of the first hook 97, and the reset state is regained in which the first hook 97 and the second hook 99 are in engagement. Released freely in this state, the control handle 79 automatically pivots to a position instructing "OFF", and forcing the lever to returns to the position of "AUTO" to regain "AUTO", permitting the state shown in FIGS. 7A to 8B to be regained.

Figure 13A:
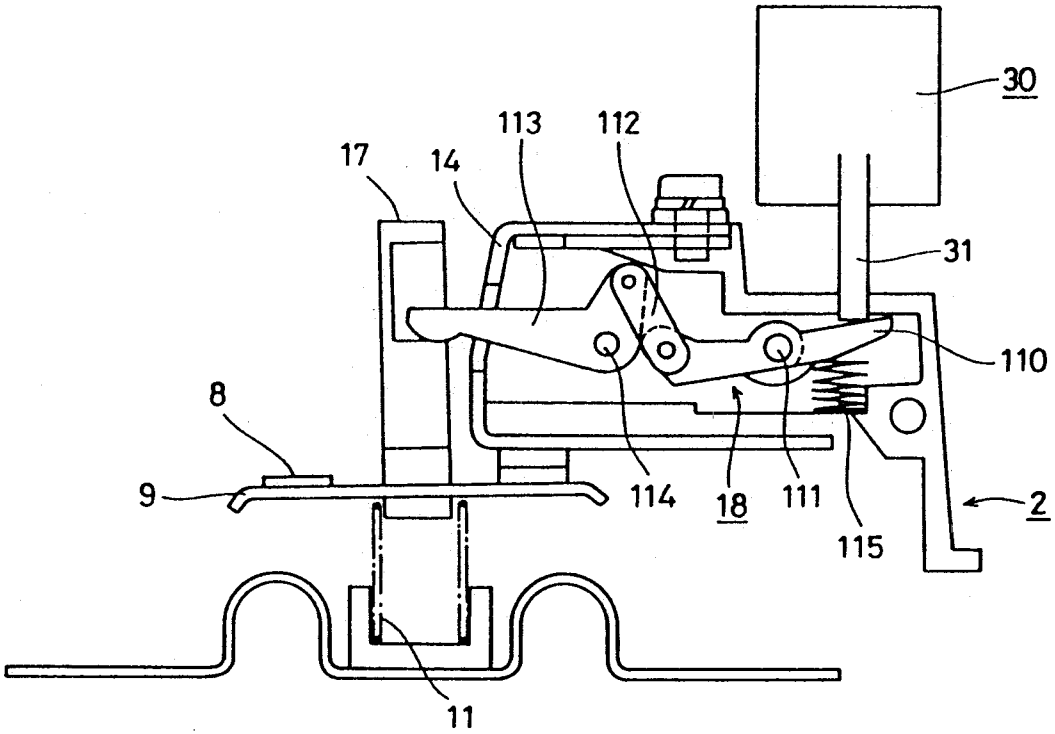
FIGS. 13A and 13B are sectional views each partially showing a structure of a forced contact parting link mechanism upon short circuit condition, FIG. 13A showing the link mechanism in a waiting state, FIG. 13B in a contacts open state.

Now, description will be given on circuit breaking operation performed through the forced contract parting electromagnet upon short circuit condition 30 which is the third parting means, and on the forced contact parting link mechanism upon short circuit condition 18 in conjunction with FIGS. 13A and 13B. FIG. 13A is an expanded view partially showing a structure of the forced contact parting link mechanism upon short circuit condition in a waiting state, and FIG. 13B is an expanded sectional view partially showing an operation state.

Figure 13B:
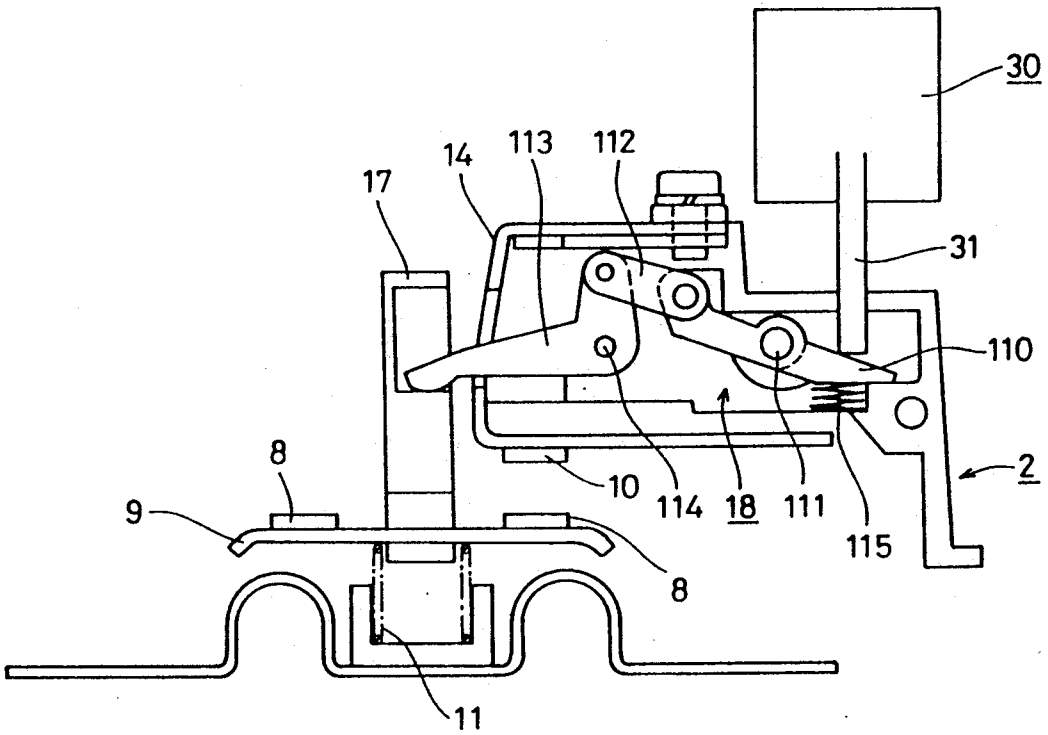

Referring to FIG. 13B, when an excessive flow of current beyond the operation current value of the forced contact parting electromagnet upon short circuit condition 30 takes place in the main current path, the forced contact parting electromagnet upon short circuit condition 30 instantly operates to protrude the protruding rod 31 downwardly. The first lever 110 is pivoted clockwise centered on the axis 110 so as to compress the drawback spring 115, in response to the movement of the rod 31. The link member 112 is raised upwardly in response to the pivotal movement of the first lever 110, and the second lever 113 is pivoted anticlockwise centered on the axis 114. The tip end of the second lever 113 lowers the switching operation lever 17. The fixed contacts 10 and the moving contacts 8 are thus parted, thereby opening the contact. Once the main current path is opened, the forced contact parting electromagnet upon short circuit condition 30 connected in series to this main current path is released from the excitation, so that the protruding rod 31 returns upwardly. At this time, the link mechanism receives an anticlockwise retaining strength by the drawback spring 115 at one end of the first lever 110, and receives a retaining strength for pivoting clockwise downwardly by the contact spring 11 provided at the bottom of the switching operation lever 17 at the other end of the second lever 113. The link member 112 receives both retaining strength in the opposite directions, and maintains the open state of the contacts by canceling these retaining strength. In other words, the forced contact parting link mechanism upon short circuit condition forms a self-retained link mechanism. The drawback movement of the link mechanism in the self-retained state as shown is achieved by further lowering the switching operation lever 17 by the spring releasing mechanism 75*b* moved by the operation of the overcurrent responsive devices 45 and 46 upon detection of an overcurrent. With the switch operation lever 17 slightly lowered, the second lever 113 is released into a state in absence of strength. The first lever 110 is pivoted anticlockwise by the drawback spring 115, and the link mechanism returns to the state shown in FIG. 13A accordingly.

In the forced contact parting link mechanism upon short circuit condition, upon the operation of the forced contact parting electromagnet upon short circuit condition, the above-described self-retained link mechanism causes the contacts to the parted, and the parted state is maintained, so that protection against recontacting after their being parted is insured, thereby improving its short circuit breaking performance.

The circuit breaker in accordance with the present invention has a mode of "TEST" or "ISOL" selected by the control handle 79, and attains a state of disconnecting the main current path in either mode. The "TEST" mode is a mode for performing monitoring operation of the circuit breaker. But "ISOL" can not perform the monitoring operation. The disconnecting portion 13 is turned "OFF" for breaking the main current path in each of these modes.

Figure 14:
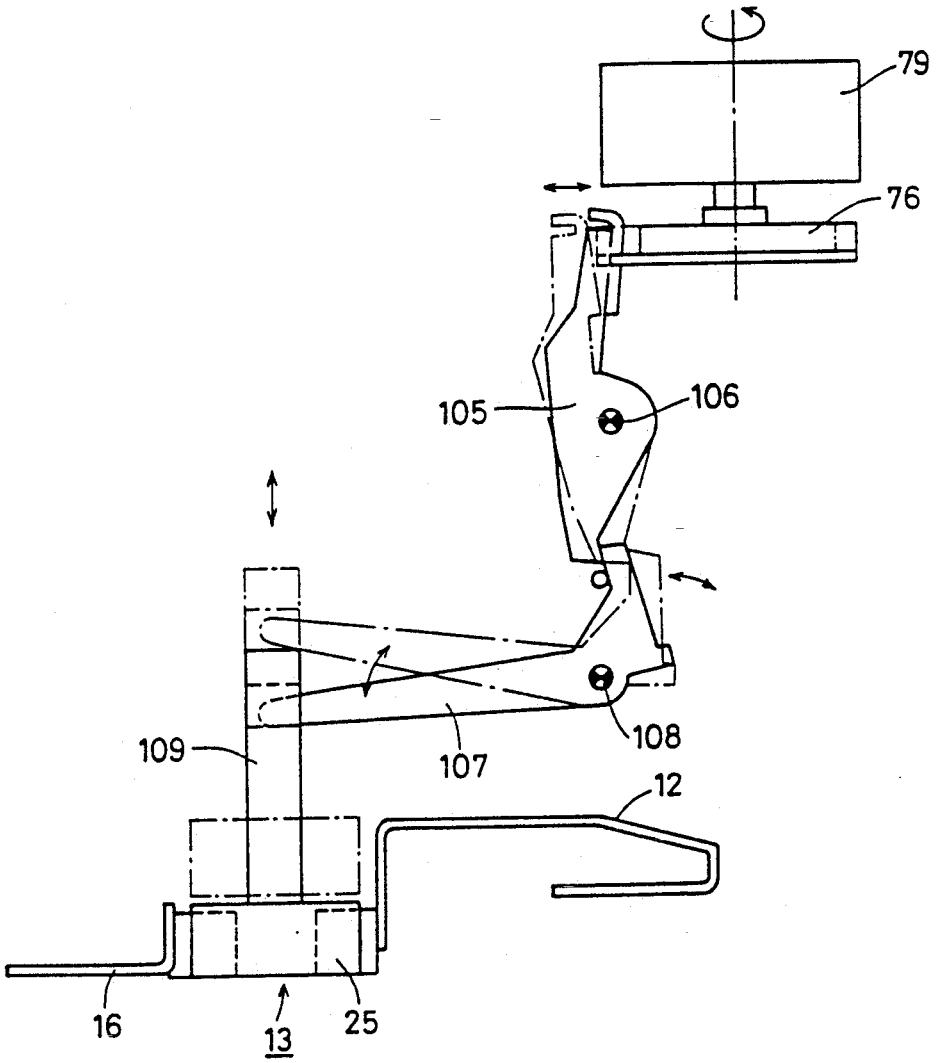
FIG. 14 is a view showing the switching mechanism of disconnecting contacts.

Referring to FIGS. 2 and 14, a disconnecting switching mechanism includes a pair of first levers 105 pivotably supported on an axis 106 and abutted on the eccentric cam 76, an L shaped second lever 107 pivotably supported on an axis 108 and engaged in the first lever 105, and a disconnecting lever 109 used in common for three paths engaged to the tip end of the second lever 107 and formed of insulator. A conductor 25 to be connected to the first fixed conductor 12 and the power supply side terminal conductor 16 are mounted inside the disconnecting lever used in common for three paths 109.

In operation, when the control handle 79 is pivoted to the position "TEST" or "ISOL", the eccentric cam 79 is likewise pivoted, causing the first lever 105 which abuts thereon to pivot anticlockwise. The second lever 107 is pivoted clockwise in accordance with the pivotal movement of the first lever 105, and the disconnecting lever used in common for three systems 109 is raised. The conductor 25 is thus detached from the power supply side terminal conductor 16 and the first fixed conductor 12, thereby opening the main current path. As will be described in the following, in the "TEST" mode, monitoring operation is possible with a limit switch 118 being in the "ON" state, but in the "ISOL" mode, the monitoring operation can not be performed with the limit switch 118 being in the "OFF" state.

Now, description will be provided on the electrical operation circuit of the breaker using the electromagnet for switching operation 60 in conjunction with FIG. 15. Connection terminal for operation 115, 116, and 117 are disposed on the upper terminal shelf of an operation mechanism unit housing 3. From one side of the power supply connection terminal 115, the excitation coil of the electromagnet for switching operation 60, the limit switch 118, and a micro switch 119 for self-retention are connected in series and further connected to the other power supply connection terminal 115*a* via an OFF button for remote control 120 which is externally provided between the connection terminals 116 and 117. A power supply E is connected between the power supply connection terminals 115 and 115*a*. An ON button for remote control 121 which is externally provided between the connection terminals 116 and 117 is connected in parallel therewith. The limit switch 118 is turned on when the control handle 79 is in the position "AUTO" or "TEST", and is otherwise turned "OFF". In other words, the limit switch 118 is mounted on the fixed frame 80 of the control mechanism for operation 75, and has its movement lever attached as to abut the bent ear 87*a* of the cross bar control lever 87. The limit switch 118 is kept in the "ON" state in, for example, "AUTO" position i.e. with the toggle links 90 and 92 being extended.

The micro switch 119 for self-retention of the electromagnet for switching operation 60 is mounted to the external plane of a fixed frame 65 inside the operation mechanism unit housing 3, the end of the moving core movement pin 73 provided at the moving core 62 of the electromagnet for switching operation 60 is attached so as to correspond to the micro switch movement lever. When the moving core 62 is attracted to the fixed core 61, the moving core movement pin 73 moves to keep the movement lever of the micro switch in the "ON" state. The "ON" and "OFF" relation between the disconnecting portion 13, the main contact 5 and the limit switch 118 in each switching position of the control handle 79 is set forth in the following table.

TABLE 1

| | AUTO | TRIP | OFF | RE-SET | TEST | ISOL |
|---|---|---|---|---|---|---|
| Disconnecting Portion | ON | ON | ON | ON | OFF | OFF |
| Main Contact | ON\|OFF | OFF | OFF | OFF | ON\|OFF | OFF |
| Limit Switch | ON | OFF | OFF | OFF | ON | OFF |

As described above, the circuit breaker in accordance with the present invention includes: the fixed contacts 10, 10, the moving contact 9 having the moving contacts 8, 8 arranged switchably to the fixed contacts 10, 10, the contact spring 11 mounted on the moving contact 9 so as to move the moving contacts 8, 8 to the fixed contacts 10, 10, the switching operation lever 17 (the first linking means) connected with the moving contact 9 and operating the moving contact 9; the second linking member formed of the electromagnetic moving lever 71 and the cross bar 74 for operating a plurality of switching operation levers 17 simultaneously; three kinds of parting means formed of the electromagnet for switching operation 60 used in common for each path the spring releasing mechanism 75*b* used in common for each path and the forced contact parting electromagnets for short circuit protection 30 each provided for every path; and the overcurrent responsive devices 45 and 46 responsive to detection of overcurrent for operation. If the control handle 79 is always in the position of "AUTO", and the electromagnet for switching operation 60 is always excited, the moving contacts 8, 8 are in contact with the fixed contacts 10, 10 by the contact spring 11, i.e. in the "ON" state.

When the electromagnet for switching operation 60 is de-energized, the second linking members 71 and 74 are operated to lower the first linking member 17 of each path, thereby parting the moving contacts 8, 8 to be kept in the "OFF" state. In other words, the switching operation of the main current path is performed by the electromagnet for switching operation 60.

When a flow of an overload current takes place in the above-described "ON" state, the electronic overcurrent relay 45 detects the overcurrent to output a detection signal, and the releasing type electromagnet 46 receives the output signal to operate to release the engagement between the first hook 97 and the second hook 99 through the transmission plates 54 and 103. Then, the spring releasing mechanism 75*b* is released to cause the cross bar control lever 87 to pivot to lower the first linking member 17. The moving contact member 9 is thus pressed downwardly to open the main current path. The pivotal movement of the cross bar control lever 87 also permits the limit switch 118 to be turned "OFF", the excitation coil 63 of the electromagnet for switching operation 60 is de-energized accordingly. Subsequently, the moving core 62 is parted from the fixed core 61 to follow the second linking members 71 and 74 which have been already moved to the open position. The circuit is thus open by the collapse of the spring releasing mechanism 75*b* at a high operating speed against the overload current, and, therefore, the breaking capability of the overload current can be improved compared to a conventional circuit breaker.

Furthermore, if a large current flow such as a short circuit current takes place, the forced contact parting electromagnet upon short circuit condition 30 is instantly energized and its protruding rod 31 causes the forced contact parting link mechanism upon short circuit condition 18 to operate, to lower the first linking means 17, parting the contacts as a result. At the same time, the electronic overcurrent relay 45 detects the short circuit current, and the releasing type electromagnet 46 and the spring releasing mechanism 75*b* operate to cause the second linking members 71 and 74 to operate in response to the output signal, thereby restraining the first linking member 17 in the open position. Therefore, the forced contact parting electromagnet upon short circuit condition 30 first operates to guide the moving contact member 9 to the open position, and the magnet 30 is de-energized, so that the forced contact parting link mechanism upon short circuit condition maintains the state of movement so as to maintain the contacts to be parted and returns to a waiting state automatically upon movement of the spring releasing mechanism, thereby maintaining the open position of the moving contact member 9. Therefore, it is not necessary to provide a special latch mechanism or a resetting mechanism to the forced contact parting electromagnet upon short circuit condition 30 for preventing re-closing. The forced contact parting electromagnet upon short circuit condition 30 and the overcurrent responsive means formed of the current transformer 41 for detecting current related to the rated current of the circuit breaker and the overcurrent responsive devices 45 and 46 can be provided in the tripping unit housing 4 by providing the forced contact parting link mechanism upon short circuit protection 18 in the switching breaking housing unit 2. The tripping unit housing 4 is readily detached by removing the screw 24 at the input end of the excitation coil 36 of the forced contact parting electromagnet upon short circuit condition 30. Consequently, a pair of the forced contact parting electromagnet upon short circuit condition 30 having current-carrying capacity and an operation setting value associated with the rated current and the overcurrent responsive means can be replaced at a time.

If the rated current is small, reducing the current-carrying capacity of the excitation coil 36 of the forced contact parting electromagnet upon short circuit condition 30 and increasing the number of winding of the coil to rise the resistance value allow the short circuit current passing to be extremely reduced. As for the drawback of the forced contact parting link mechanism upon short circuit condition 18 to the waiting state after its operation can be made by producing the non-excitation state of the electromagnet for switching operation to further lower the switching operation lever 17, other than the above-described operation of the spring releasing mechanism **75*b*. The forced contact parting link mechanism upon short circuit condition 18 in accordance with the present invention is therefore applicable to any circuit breaker including at least one of the spring releasing mechanism 75*b* and the electromagnet for switching operation 60**.

As described above, the circuit breaker in accordance with the present invention includes the link mechanism engaged between the first linking member for switching between the fixed contacts and the forced contact parting electromagnet upon short circuit condition, and because of the self-retaining function and the self-resetting function provided for the link mechanism, re-conduction can be surely prevented upon breaking short circuit current, so that manual resetting operation can be avoided and automatic resetting operation of the circuit can be performed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A circuit breaker, comprising:

fixed contacts provided for a main current path from a power supply side circuit terminal to a load side circuit terminal;

a moving contact means including moving contacts for closing/opening a circuit by moving said moving contacts in relation to said fixed contacts;

first linking means in contact with said moving contact means for enabling the operation of said moving contact means;

second linking means for operating said first linking means;

circuit switching means including a voltage-operated electromagnet having a moving portion, a fixed portion and a spring, wherein the moving portion is moved by said spring in a non-excitation state and moves said second linking means to a position in which said moving contacts are parted;

forced contact parting means including a current-operated electromagnet provided in said main current path and operative in response to an excessive flow of current beyond a prescribed value and a link mechanism engaged between said current-operated electromagnet and said first linking means for parting said moving contacts by moving said first linking means in response to the operation of said current-operated electromagnet;

means for maintaining a parted state of said moving contacts by holding an engagement state of said forced contact parting means to said first linking means when said current-operated electromagnet returns to a non-operation state; and means for returning the breaker to a waiting state, wherein said forced contact parting means is released from engagement to said first linking means when said voltage-operated electromagnet attains a non-excitation state and said first linking means is further moved by said second linking means.

2. The circuit breaker in accordance with claim 1, wherein said current-operated electromagnet in said forced contact parting means upon short circuit condition is of a plunger type, said link mechanism includes a first lever, a second lever and a link member, one end of said first lever abutting the plunger of said current-operated electromagnet, the other end of said first lever being linked to one end of said link member, the other end of said link member being linked to one end of said second lever, the other end of said second lever abuts said first linking means, upon operation of said current-operated electromagnet, said plunger operates said first lever to cause said second lever to move said first linking means through said link member, to part said moving contacts, said link mechanism maintains its position after the parting, and when said voltage-operated electromagnet attains a non-excitations state and further moves said first linking means by said second linking means, the engagement between said second lever and said first linking means is released so that said link mechanism returns to the state before the operation of said current-operated electromagnet.

3. A circuit breaker, comprising:

fixed contacts provided for a main current path from a power supply side circuit terminal to a load side circuit terminal;

a moving contact means including moving contacts for closing/opening a circuit by moving said moving contacts in relation to said fixed contacts;

first linking means in contact with said moving contact means for permitting operation of said moving contact;

second linking means for operating said first linking means;

an overcurrent responsive means responsive to detection of an overcurrent for operation;

a spring releasing mechanism including a toggle link mechanism having a spring and a lever disposed at one end of said toggle link mechanism for operating said second linking means, and a latch mechanism for transmitting a signal from said overcurrent responsive means to said toggle link mechanism and for releasing said spring, said lever maintaining said second linking means in a position which can be contacted by said moving contacts when said spring is fully charged, and moving said second linking means to a position in which said moving contacts are parted when said latch mechanism operates in response to the signal from said overcurrent responsive means and said spring is released; and forced contact parting means including a current-operated electromagnet provided in said main current path and operative in response to a flow of an overcurrent beyond a prescribed value, a link mechanism engaged between said current-operated electromagnet and said first linking means for parting said moving contacts by moving said first linking means in response to the operation of said current-operated electromagnet;

means for maintaining a parted stated of said moving contacts by holding an engagement state of said forced contact parting means to said first linking means when said current-operated electromagnet returns to a non-operation state; and means for returning the breaker to a waiting state, wherein said forced contact parting means is released from engagement to said first linking means when said spring releasing mechanism operates to further move said first linking means by said second linking means, thereby maintaining the parted state of said moving contacts.

4. The circuit breaker in accordance with claim 3, wherein said current-operated electromagnet in said forced contact parting means upon short circuit condition is of a plunger type, said link mechanism includes a first lever, a second lever, and a link member, one end of said first lever abutting the plunger of said current-operated electromagnet, the other end of said first lever being linked to one end of said link member, the other end of said link member being linked to one end of said second lever, the other end of said second lever abutting said first linking means, upon operation of said current-operated electromagnet, said plunger operates said first lever to cause said second lever to move said first linking means through said link member, thereby opening said moving contacts, said link mechanism maintains its position after the parting, and when said spring releasing mechanism operates to further move said first linking means by said second linking means, said link mechanism is released from the engagement to said first linking means and returns to the waiting state before the operation of said current operated electromagnet.

5. A circuit breaker, comprising:

fixed contacts provided for a main current path from a power supply side circuit terminal to a load side circuit terminal;

a moving contact means including moving contacts for closing/opening a circuit by moving said moving contacts in relation to said fixed contacts;

first linking means in contact with said moving contact means for enabling the operation of said moving contact means;

second linking means for operation of said first linking means;

an overcurrent responsive means operative in response to detection of an overcurrent; and a spring releasing mechanism including a toggle link mechanism having a spring and a lever disposed at one end of the toggle link mechanism for operating said second linking means, and a latch mechanism for transmitting a signal from said overcurrent responsive means to said toggle link mechanism and for releasing said spring, said lever maintaining the second linking means in a position which can be contacted by said moving contacts when said spring is fully charged, and moving said second linking means to a position in which said moving contacts are parted when said latch mechanism operates by the signal from said overcurrent responsive means, and said spring is released;

circuit switching means including a voltage-operated electromagnet having a moving portion, a fixed portion and a spring, wherein the moving portion is moved by said spring in a non-excitation state and moves said second linking means to a position in which said moving contacts are parted; and forced contact parting means including a current-operated electromagnet provided in said main current path and operative in response to an excessive flow of current beyond a prescribed value, a link mechanism engaged between said current operated electromagnet and said first linking means for parting said moving contacts by moving said first linking means in response to the operation of said current-operated electromagnet;

means for maintaining a parted state of said moving contacts by holding an engagement state of said forced contact parting means to said first linking means even when said current-operated electromagnet returns to a non-operation state; and means for returning the breaker to a waiting state, wherein said forced contact parting means is released from engagement to said first linking means when said first linking means is further moved by said second linking means to maintain a parted state of said moving contacts by operation of said spring releasing mechanism or said voltage-operated electromagnet.

6. A circuit breaker, comprising:

a pair of fixed contacts provided in a main current path between a power supply side circuit terminal and a load side circuit terminal;

a movable contact means for opening/closing said main current path by contacting/parting to/from said pair of fixed contacts;

first linking means connected to said movable contact means and capable of shifting;

first spring means for urging said movable contact means to be contacted to said pair of fixed contacts;

a current-operated electromagnet excited in response to generation of an excessive current above a prescribed value in said main current path for moving a plunger in a prescribed direction;

transmission means for transmitting the movement of said plunger in the prescribed direction to said first linking means, thereby parting said movable contact means from said pair of fixed contacts against the urging force of said first spring means;

second spring means for urging said transmission means to return to its original position;

parted state maintaining means for balancing the urging force of said first spring means acting upon said transmission means and the urging force of said second spring means, thereby fixing the position of said transmission means and maintaining the parted state of said movable contact means and said pair of fixed contacts; and urging force cut-off means, operative after the transmission of the force to said movable contact means by said transmission means, for moving said movable contact means against the urging force of said first spring means in accordance with generation of said excessive current, thereby cutting off the urging force of said first spring means acting upon said transmission means.

7. A circuit breaker, comprising:

a pair of fixed contacts provided in a main current path between a power supply side circuit terminal and a load side circuit terminal;

a movable contact means for opening/closing said main current path by contacting/parting to/from said pair of fixed contacts;

first linking means connected to said movable contact means and capable of shifting;

first spring means for urging said movable contact means to be contacted to said pair of fixed contacts;

a current-operated electromagnet excited in response to generation of an excessive current above a prescribed value in said main current path for moving a plunger in a prescribed direction;

transmission means for transmitting the movement of said plunger in the prescribed direction to said first linking means, thereby parting said movable contact means from said pair of fixed contacts against the urging force of said first spring means;

parted state maintaining means for balancing the urging force of said first spring means acting upon said transmission means and reaction force acting upon said transmission means, thereby fixing the position of said transmission means and maintaining the parted state of said movable contact means and said pair of fixed contacts; and urging force cut-off means, operative after the transmission of the force to said movable contact means by said transmission means, for moving said movable contact means against the urging force of said first spring means in accordance with generation of said excessive current, thereby cutting off the urging force of said first spring means acting upon said transmission means.

8. A circuit breaker as recited in claim 7, wherein said transmission means includes:

a first pivotable lever having one end thereof in abutment upon said plunger;

a second pivotable lever having one end thereof in abutment upon said first linking means; and a link member for coupling the other end of said first lever and the other end of said second lever.

9. A circuit breaker as recited in claim 7, wherein said urging force cut-off means includes:

a voltage-operated electromagnet having a fixed portion, a movable portion moving in response to an instruction of opening/closing said main current path, and an urging spring for moving said movable portion away from said fixed portion in a non-excited state; and second linking means for transmitting the movement of said movable portion urged by said spring to said first linking means, thereby moving said movable contact means against the urging force of said first spring means.

10. A circuit breaker as recited in claim 7, wherein said urging force cut-off means includes:

an excessive current responsive means operable in response to a detection of an excessive current; and moving means for transmitting the movement of said excessive current responsive means to said first linking means, thereby moving said movable contact means against the urging force of said first spring.

* * * * *